United States Patent [19]

Furukawa

[11] Patent Number: 5,010,645

[45] Date of Patent: Apr. 30, 1991

[54] FOLDABLE T-SHAPED SHAVER

[76] Inventor: Hironori Furukawa, 11344 Tortuga St., Cypress, Calif. 90630

[21] Appl. No.: 468,178

[22] Filed: Jan. 22, 1990

[51] Int. Cl.[5] ..... B26B 21/00

[52] U.S. Cl. ..... 30/47

[58] Field of Search ..... 30/32, 47, 50, 66, 86, 30/87, 88, 89

[56] References Cited

U.S. PATENT DOCUMENTS

| | | | |
|---|---|---|---|
| 756,615 | 4/1904 | Fornander | 30/47 |
| 1,548,164 | 8/1925 | Parker | 30/47 |
| 1,748,376 | 2/1930 | Anderson | 30/47 |
| 2,121,000 | 6/1938 | Anderson | 30/47 |
| 2,755,549 | 7/1956 | Hulkenberg, Jr. | 30/47 |

*Primary Examiner*—Douglas D. Watts
*Assistant Examiner*—Paul M. Heyrana, Sr.
*Attorney, Agent, or Firm*—Brown, Martin Haller & McClain

[57] ABSTRACT

A T-shaped shaver of a design which is capable of compact and safe storage. The shaver of the present invention has an elongated base stem having a groove extending along a substantial portion of the base stem length and an elongated extension stem rotatably connected at one end thereof to a corresponding end of the base stem. The extension stem other end has a depression formed in a front side. A razor blade holder having a razor blade mounted therein is rotatably connected to the other end of the extension stem. The razor blade holder has a projection formed thereupon facing the extension stem front side with the projection mating with the depression when the razor blade holder is perpendicular to the extension stem.

5 Claims, 1 Drawing Sheet

FOLDABLE T-SHAPED SHAVER

BACKGROUND OF THE INVENTION

The present invention relates to razors for shaving body hair. More specifically the present invention relates to a novel and improved foldable T-shaped razor or shaver adapted for compact and safe storage.

There exists many variations of razors or shavers for shaving body hair. Most common are the conventional T-shaped shavers such as illustrated in FIGS. 4 and 5. A conventional T-shaped shaver includes a handle or stem 10. Fixably connected perpendicularly at one end of stem 10 is razor blade holder 12 which holds razor blade 14.

Conventional T-shaped shavers, such as illustrated in FIGS. 4 and 5, are obviously bulky due to their shape. Accordingly the shape of such shavers is not conducive to compact storage. Such shavers do not fit nicely into the pocket or purse.

Furthermore, for safety purposes conventional T-shaped shavers require a plastic cover or case to cover the razor blade. Thus an additional component is needed with the shaver that is susceptible to loss or inadvertent removal.

It is therefore a object of the present invention to provide a novel and improved T-shaped shaver that is capable of compact storage.

It is yet another object of the present invention to provide a T-shaped shaver having an integrated safety feature for providing safe coverage of the razor blade during storage.

SUMMARY OF THE INVENTION

The present invention is a novel and improved T-shaped shaver of a design which is capable of compact and safe storage. The shaver of the present invention has an elongated base stem having a groove extending along a substantial portion of the base stem length and an elongated extension stem rotatably connected at one end thereof to a corresponding end of the base stem. The extension stem's other end has a depression formed in a front side. A razor blade holder having a razor blade mounted therein is rotatably connected to an other end of the extension stem at the front side. The razor blade holder has a projection formed thereupon facing the extension stem depression with the projection mating with the depression when the razor blade holder is rotated perpendicular to the length of the extension stem.

When the shaver is to be used, the extension stem is rotated to a position in line with the base stem to form an elongated handle. The razor blade holder is then rotated perpendicular to the length of the extension stem. When the shaver is to be stored, the razor blade holder is rotated to a position parallel with the extension stem. The extension stem is then rotated at the rotary connection of the base stem and extension stem so that the extension stem and razor blade holder fit within the groove of the base stem.

BRIEF DESCRIPTION OF THE DRAWINGS

These and other features, objects and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENT

Figure 1:
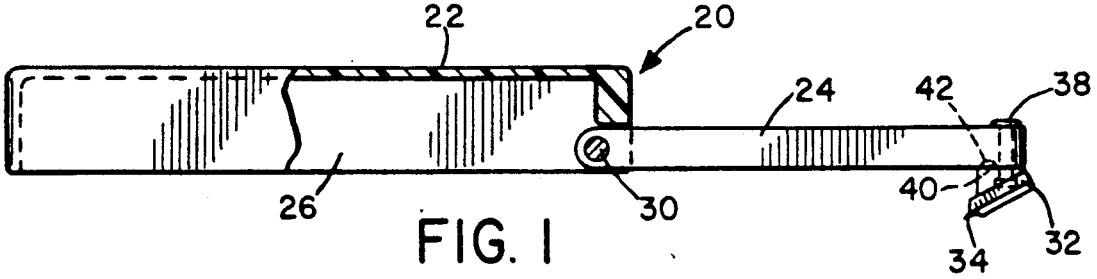
FIG. 1 is a side elevation view, partially cut away, of the shaver of the present invention in an open position ready for use.
Figure 2:
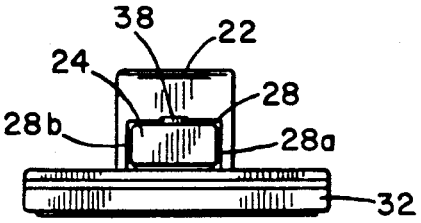
FIG. 2 is an end view of the open shaver of FIG. 1.

Turning now to the drawings, in FIG. 1 a T-shaped shaver of the present invention is illustrated in the open position ready for use. In FIG. 1 the shaver has a handle 20 which comprises base stem 22 and extension stem 24. Base stem 22 includes an axially oriented cavity or longitudinal groove 26 formed therein extending a substantial portion of the length. Base stem 22 includes at one end a recess or cutout 28 (FIG. 2).

Figure 3:
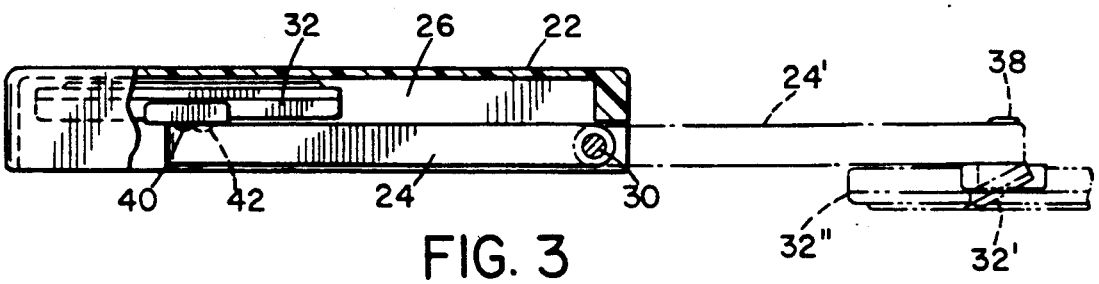
FIG. 3 is a side elevation view, partially cut away, showing the shaver with the shaver illustrated in the fully closed, partially folded and fully open positions.
Figure 4:
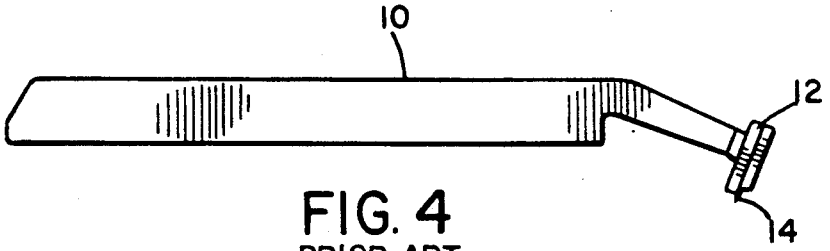
FIG. 4 PRIOR ART
FIG. 4 is a side elevation view of a typical conventional shaver.
Figure 5:
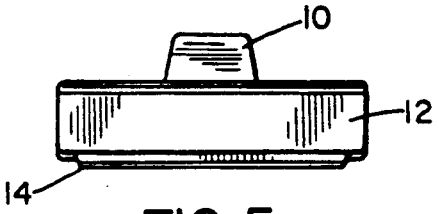
FIG. 5 PRIOR ART
FIG. 5 is an end view of the conventional shaver illustrated in FIG. 4.

Extension stem 24 is rotatably coupled at one end thereof by pin 30 to the end of base stem 22 at recess 28. Pin 30 is positioned perpendicular to a common longitudinal axis of base stem 22 and extension stem 24. Pin 30 is further oriented such that it extends across the inner opposite sides 28*a* and 28*b* of recess 28. Pin 30 defines an axis of rotation from which extension stem 24 rotates about from a fully extended position, such as illustrated in FIG. 1, to a fully closed position in groove 26, such as illustrated in FIG. 3. Although illustrated in FIG. 1 with extension stem 24 in a common axis with base stem 22, it should be further understood that a stop may be provided in recess 28 such that extension stem 24 would be at an angle to the longitudinal axis defined by base stem 22.

At the end of extension stem 24 opposite the coupling to base stem 22, razor blade holder 32 is mounted. Holder 32 is configured to hold either single or double razor blades for shaving. For purposes of illustration, holder 32 contains a single razor blade 34. Holder 32 is mounted to extension stem 24 such that razor blade 34 is positioned at an angle from extension stem 24 and facing outward therefrom.

Holder 32 is mounted at front side 36 of extension stem 24 by pin 38 which extends through extension stem 24. Pin 38 is perpendicular to both the common longitudinal axis of base stem 22 and extension stem 24, and the axis of rotation defined by pin 30.

Holder 32 has a projection or bump 40 formed thereupon facing side 36. Formed in extension stem 24 at side 36 is a mating depression 42 for receiving bump 40. When holder 32 is rotated perpendicular to extension stem 24, bump 40 is aligned with depression 42 and is received therein. The combination of bump 40 and depression 42 provides a means for retaining holder 32 in a position to facilitate shaving.

FIG. 3 illustrates the shaver of the present invention in various stages from the fully open, partially folded and fully closed. As illustrated in broken lines, extension stem 24' is folded out from base stem 22 in the open position. Holder 32' is shown perpendicular to extension stem 24'. Holder 32' is locked in this position by the bump-depression combination as previously discussed.

In this fully open position, the shaver is ready to be used for shaving.

In order to store the shaver in a compact position, holder 32' is rotated approximately 90 degrees to a position parallel to extension stem 24', such as illustrated by holder 32" as shown in broken lines. After moving the holder to the position parallel to the extension stem, the extension stem is rotated about pin 30 by approximately 180 degrees so as to fold extension stem 24, and the rotated holder 32, into groove 26 of base stem 22. The shaver is thus in the fully closed position.

When the shaver is in the fully closed position, the shaver may be safely stored. In the fully closed position, the razor blade is safely positioned against the inner wall of base stem 22 formed by groove 26. Thus base stem 22 serves as a safety cover in addition to as a handle and storage compartment.

The present invention exemplifies a design for a T-shaped shaver which permits compact storage of the shaver. Furthermore the shaver of the present invention integrates a safety cover for the razor blade within the shaver itself, thus eliminating the need for a separate razor blade cover.

Although the shaver is illustrated in a somewhat rectangular cross-sectional design, it is envisioned that other shapes may be readily devised. Various other ornamental shapes may be used but the teachings of the present invention are readily adapted thereto. It is envisioned that the shaver of the present invention may be made of plastic or any other type of rigid material, except for the razor blade itself which is formed of commonly known materials used therefor. The shaver of the present invention is further applicable to both disposable and razor blade changeable designs.

The previous description of the preferred embodiment is provided to enable any person skilled in the art to make or use the present invention. Various modifications to this embodiment will be readily apparent to those skilled in the art, and the generic principles defined herein may be applied to other embodiments without the use of the inventive faculty. Thus, the present embodiment is not intended to be limited to the embodiment shown herein, but is to be accorded the widest scope consistent with the principles and novel features disclosed herein.

I claim:

1. A shaver comprising:

a grooved based stem having two ends;

an extension stem having two ends connected rotatably about a first axis at one said end thereof to one said end of said grooved base stem; and a razor blade holder for holding a razor blade connected rotatably about a second axis perpendicular to said first axis to the other said end of said extension stem.

2. The shaver of claim 1 further comprising means for retaining said razor blade holder in a shaving position perpendicular to said extension stem.

3. The shaver of claim 1 wherein said extension stem can be rotated from a position within said grooved base stem to a position that defines a unitary handle and said razor blade holder can be rotated to a position perpendicular to said unitary handle that defines an open position.

4. The shaver of claim 1 wherein said extension stem can be rotated to a position within said base stem groove and said razor holder can be rotated to a position parallel to said extension stem that defines a closed position where both said extension stem and said razor blade holder are positioned entirely within said base stem groove.

5. A foldable T-shaped shaver comprising:

an elongated base stem having two ends and a groove extending for a substantial portion of the base stem length;

an elongated extension stem having a first and a second end and being rotatably connected at said first end thereof to one said end of said base stem, said second end of said extension stem having a front side with a depression formed in said front side;

a razor blade holder, having a razor blade mounted therein, rotatably connected to said front side of said second end of said extension stem, said holder having a projection formed thereon facing said extension stem front said with said projection mating with said depression when said holder is perpendicular to said extension stem.

* * * * *